US006446888B1

(12) United States Patent
Williams, Sr.

(10) Patent No.: US 6,446,888 B1
(45) Date of Patent: Sep. 10, 2002

(54) GRINDING APPARATUS WITH VERTICAL STATIC SEPARATORS

(76) Inventor: Robert M. Williams, Sr., 16 La Hacienda, Ladue, MO (US) 63124

( * ) Notice: Subject to any disclaimer, the term of this patent is extended or adjusted under 35 U.S.C. 154(b) by 0 days.

(21) Appl. No.: 09/708,844

(22) Filed: Nov. 8, 2000

(51) Int. Cl.[7] ..... B02C 23/12
(52) U.S. Cl. ..... 241/79.1; 241/80
(58) Field of Search ..... 241/79.1, 80, 97

(56) References Cited

U.S. PATENT DOCUMENTS

| | | | | |
|---|---|---|---|---|
| 2,913,109 A | | 11/1959 | Williams | |
| 3,310,059 A | * | 3/1967 | Grinzinger | 241/80 |
| 3,337,142 A | | 8/1967 | Williams | |
| 4,022,387 A | | 5/1977 | Williams | |
| 4,061,274 A | | 12/1977 | Williams | |
| 4,184,640 A | | 1/1980 | Williams | |
| 4,226,371 A | | 10/1980 | Williams | |
| 4,461,428 A | | 7/1984 | Williams | |
| 4,478,371 A | | 10/1984 | Williams | |
| 4,489,664 A | | 12/1984 | Williams | |
| 4,522,343 A | | 6/1985 | Williams | |
| 4,602,744 A | | 7/1986 | Williams | |
| 4,602,745 A | * | 7/1986 | Maliszewski et al. | 241/80 |
| 4,640,204 A | | 2/1987 | Williams | |
| 4,830,290 A | | 5/1989 | Williams | |
| 4,982,905 A | * | 1/1991 | Holsiepe et al. | 241/80 |
| 4,993,647 A | | 2/1991 | Williams | |
| 5,279,466 A | | 1/1994 | Williams | |
| 5,330,110 A | | 7/1994 | Williams | |
| 5,383,612 A | | 1/1995 | Williams | |
| 5,611,494 A | | 3/1997 | Williams | |
| 5,839,673 A | | 11/1998 | Williams | |

OTHER PUBLICATIONS

Bulletin 930 Index KK Williams Direct Fired Systems; 8 pages.
Bulletin 930 Index KK Williams Direct Fired Systems; 11 pages.
Bulletin 856–R Williams: Fluid Bed Roller Mill Systems; 6 pages.
Bulletin 882–R Williams: Impact Dryer Mill; 4 pages.

* cited by examiner

*Primary Examiner*—Mark Rosenbaum
(74) *Attorney, Agent, or Firm*—Polster, Lieder, Woodruff & Lucchesi, L.C.

(57) ABSTRACT

An improvement to the conventional grinding mill and separator designs which facilitates the use of larger diameter grinding surfaces and additional numbers of grinding rollers by equalizing the gas velocity around the grinding rollers and journal with the gas velocity employed to fluidize the feed particulate material. A plurality of peripheral vertical static separators are located about the grinding chamber and above the grinding rollers to provide an increase in the cross-sectional area of the grinding mill vertical shaft, thereby reducing the gas velocity around the grinding rollers and journal. The peripheral vertical static separators are configured with a trapezoidal sectional area, such that oversize particulate material falling into the peripheral vertical static separators is redirected into the grinding chamber, resulting in an increase in the number of grinding chamber material introduction points. Centrifugal action of the grinding journal ejects oversize particulate material directly into the peripheral vertical static separators before it reaches the separator chamber, thereby functioning as a first stage separator and permitting the separator chamber to be run at a slower speed, reducing overall power consumption.

12 Claims, 5 Drawing Sheets

GRINDING APPARATUS WITH VERTICAL STATIC SEPARATORS

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

The present invention is directed to particle sorting in an apparatus for grinding fuel or other material prior to its delivery to a boiler or other point of use, and in particular, to an improvement for equalizing gas velocity around large roller grinder journals to reduce vertical cycling of larger particles and to function as a first stage separator, returning and directing larger particles to the roller grinders for further reduction.

In the processing of particulate material, like coal, rock, and similar particulates that require reduction in the size of particles prior to processing, isokinetic separator apparatus such as is shown in U.S. Pat. No. 5,279,466 to Williams, herein incorporated by reference, are known. The '466 Williams patent discloses an apparatus for grinding material consisting of both desirable fines and undesirable oversize particles, in which a separator rotor is equipped with shaped blades to isokinetically separate out the oversize particles and return them to a grinder for further reduction.

The design of these grinders conventionally includes either a hammer mill or a roller mill such as is disclosed in U.S. Pat. No. 4,522,343 to Williams, herein incorporated by reference. The '343 Williams patent discloses an apparatus for grinding coal to micron fineness having a grinding chamber with a grinding surface supported by a circumferential wall in the grinding chamber and four grinding rolls orbiting in the grinding chamber for grinding the coal between the roller surface and the grinding surface. Typically, the inner diameter of the grinding surface in conventional grinding mills is approximately 74 inches across. Scaled up designs for larger grinding mills, having an inner grinding surface diameter of approximately 100 inches, and more than 4 grinding rollers have been attempted. However, it has been found that use of additional grinding rollers reduces the cross-sectional area through which particulate material can pass in a vertical direction between the grinding rollers and the grinding mill journal, resulting in an increase in the velocity of the fluidizing gasses passing therethrough. The increased velocity of the fluidizing gasses forces larger particles up out of the grinding chamber, and into the particle separator area, wherein they are rejected and returned to the grinding chamber. Due to the increased velocity of the fluidizing gasses, the rejected particles are again ejected from the grinding chamber, cycling between the particle separator and the grinding chamber, resulting in an increase in power consumption by the grinding mill, separator and air system that must support the fluidized accumulation.

BRIEF SUMMARY OF THE INVENTION

Briefly stated, the present invention is an improvement to the conventional grinding mill and separator designs which facilitates the use of larger diameter grinding surfaces and additional numbers of grinding rollers by equalizing the gas velocity around the grinding rollers and journal with the gas velocity employed to fluidize the particulate material. Specifically, in a preferred embodiment, a plurality of peripheral vertical staticseparators are located above the grinding chamber and grinding rollers to provide an increase in the cross-sectional area of the grinding mill, thereby reducing the gas velocity around the grinding rollers and journal. In addition to increasing the cross-sectional area of the grinding mill, the vertical static separators are configured with a trapezoidal sectional area, such that oversize particulate material falling or flung by the rotating journals into the vertical static separator is redirected down into the grinding chamber, resulting in an increase in the number of grinding chamber material introduction points. Finally, the centrifugal action of the grinding journal ejects oversize particulate material directly into the peripheral vertical static separators before it reaches the spinner separator, thereby allowing the vertical static separator to function as a first stage separator and permitting the spinner separator chamber to be run at a slower speed, reducing power consumption of the separator and primary fluidizing fan.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
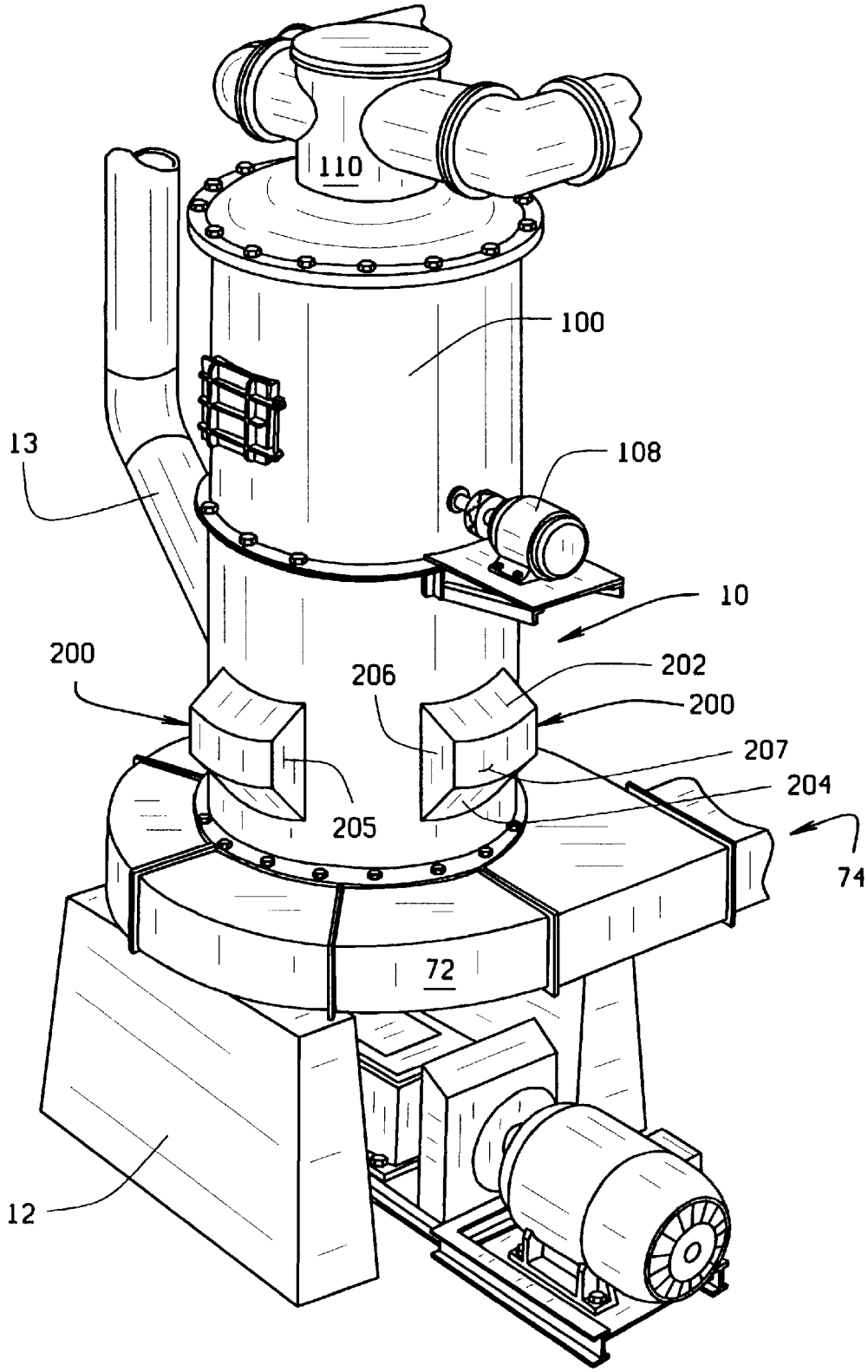
FIG. 1 is perspective view of a grinding mill and separator employing peripheral vertical static separators of the present invention.
Figure 2:
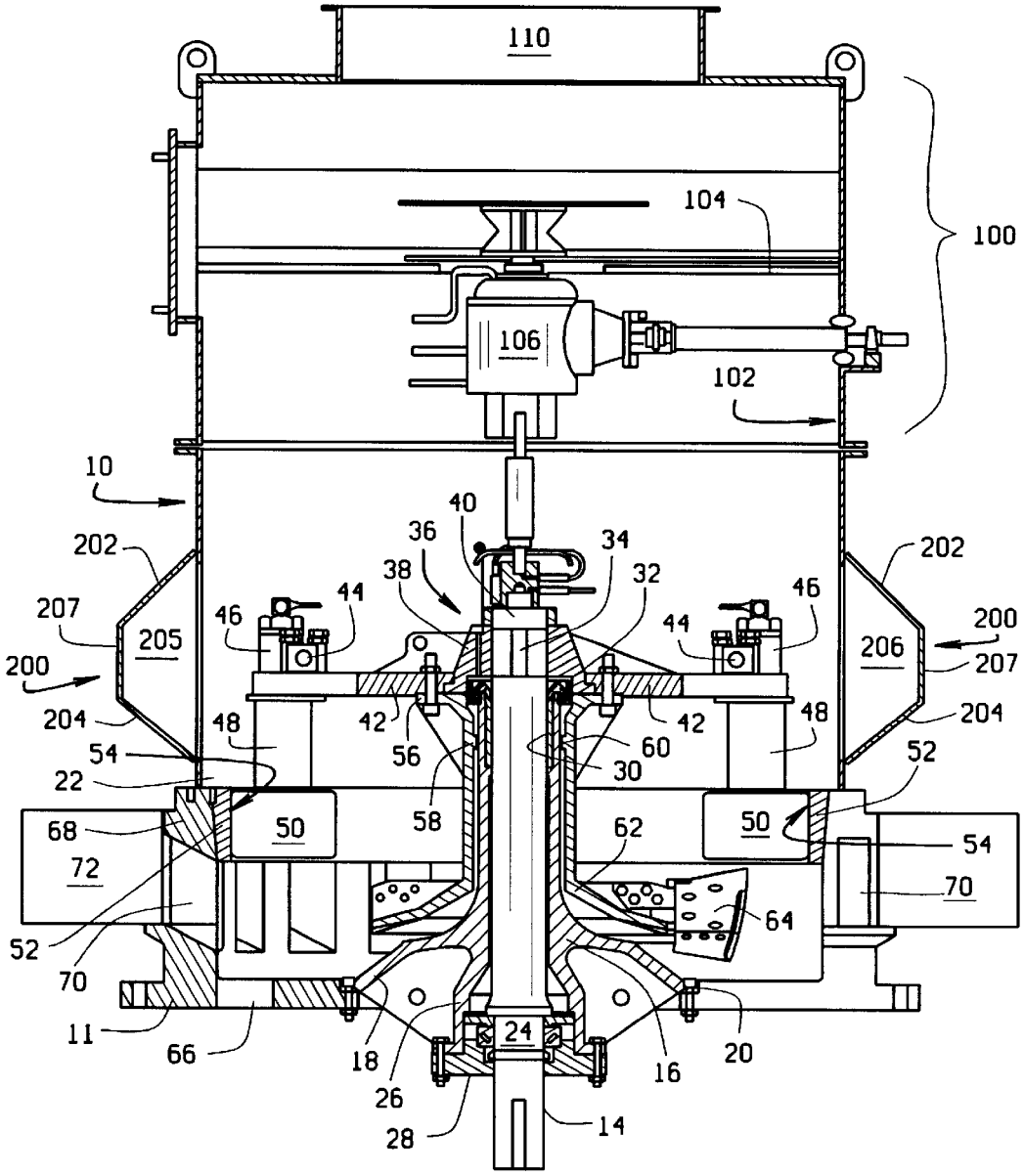
FIG. 2 is a longitudinal cross-sectional representation of the grinding mill and separator of FIG. 1.

The present roller mill assembly seen in FIGS. 1 and 2 embodies a main frame structure 10 formed with a mounting flange 11 by which the frame may be supported on a suitable base 12. The main frame structure includes a material feed tube 13 for introduction of material into the grinding apparatus. A drive shaft 14 extends vertically upward through a fixed column 16, which is formed with a bell bottom wall 18, having its circumferential lip 20 mounted in the frame 10 for support and to close the bottom of a grinding chamber 22.

The shaft 14 is supported in a thrust bearing assembly 24 carried in a socket 26 depending from the underside of the bell bottom wall 18. The socket is closed by a removable closure plate 28. As the drive shaft 14 passes upwardly through the column 16 it is stabilized by a guide sleeve 30 supported on a rib projecting inwardly to support the sleeve. A seal element is held in place on the rib at the lower end of the sleeve 30. The upper end of the column 16 is provided with a lubrication reservoir 32 surrounding the portion of the shaft just below its projecting end 34. A head member in the form of a spider structure 36 has a central hub 38 engaged on the end 34 of the shaft 14 and is held in place by a nut 40 so that the head member 36 rotates with the shaft 14.

The head member 36 has a plurality of arms 42 (two being shown in FIG. 2). Each arm carriers bearings 44 and a hanger trunnion 46 is pivotally carried by bearing 44 for the purpose of supporting a hanger shaft 48 for carrying a grinding roller 50 at a predetermined level. The level of the grinding rollers 50 is surrounded by a bull ring 52 which is fixed in a tapered seat in the frame 10 and presents an inward grinding face 54 to the rollers 50.

In FIG. 2, it can be seen that the head member 36 is attached at its underside to the top flange 56 of a tubular shaft 58 which surrounds the column 16 and has a stabilizing shoulder 60 engaged about the column 16. The lower end of the tubular shaft 58 is flared outwardly to provide arms 62 to support plow blades 64. The arms are orientated relative to the grinding rollers 50 so that a flow precedes a grinding roller 50 so that the material to be ground will be thrown upwardly into the path of travel of the rollers 50 at the level of the bull ring 52. Thus, the plows 64 rotate in a space below the grinding rollers 50, such space having its bottom defined by the bell bottom wall 18. An aperture 66 is provided in the bottom of this space for the discharge of a portion of the material being processed, such as tramp metal and hard to grind components.

In operation, it can be understood that each hanger shaft 48 and its roller is free to pivot radially inward toward the center column 16, and the roller is forced by centrifugal action upon rotation of the shaft 14 and head member 36 toward the fixed bull ring 52. It is undesirable to allow the roller 50 to engage the bull ring. This normally is prevented by the bed of grindable material in the area provided by the plow 64 or oversized feed material and the gas fluidized ground material that has recycled. If contact is obtained the result is vibration and noise of an extreme intensity such that the mill will self-destruct if not shut down.

Figure 3:
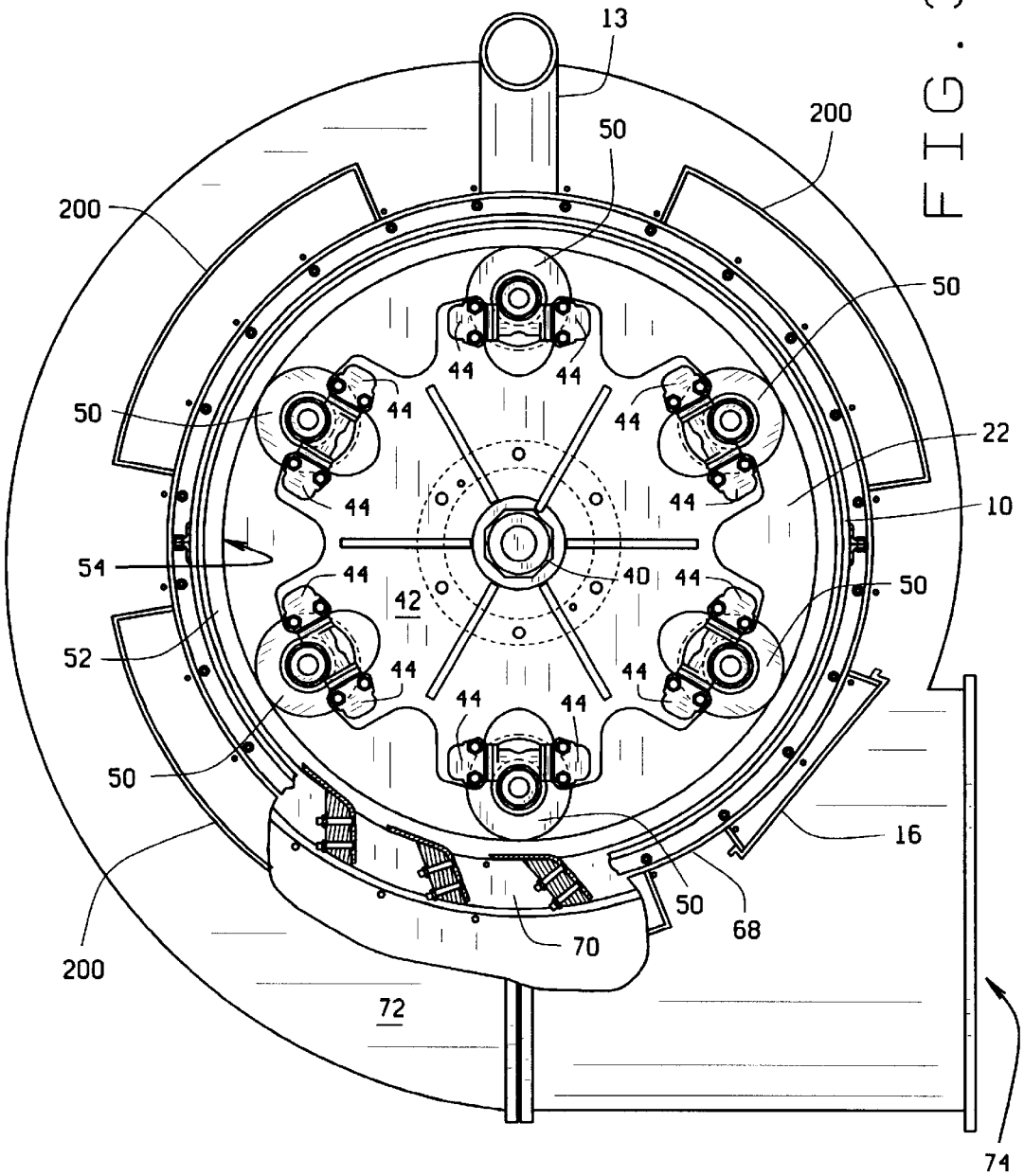
FIG. 3 is an axial cross-sectional representation of the grinding chamber of the grinding mill and separator of FIG. 1, illustrating the placement of the grinding rollers and journal.

Turning now to FIG. 3, it can be seen that the grinding chamber 22 is enclosed by the wall 68 of the frame structure 10. The frame 10 includes an access door 16 for access to the previously described grinding apparatus. The frame 10 is formed with a plurality of openings 70 which connect the chamber 22 with a wind box or air bustle 72 which surrounds and encloses the frame 10, at least at the level of the openings 70. Air is admitted to the bustle 72 at inlet 74. As is described in U.S. Pat. No. 4,522,343 to Williams, the arrangement of air directing passages secured to each opening 70 is selected so as to cause the airflow to spin in a clockwise direction, imparting a centrifugal force or horizontal component to the particulate material in the chamber to lift it upward between the rollers 50 and the bull ring 52.

As seen in FIG. 2, the output of the grinding chamber is delivered to a spinner separator 100 wherein the larger particles are caused to move to the outer wall 102 by the centrifugal fan action of the blades 104 driven by a gear mechanism 106 from an external motor 108. The larger particles thus separated fall by gravity back into the grinding chamber 22 and re-enter the mass of material being moved by the spinning action of the air inducted through the openings 70 through the orbit of the rollers 50 at the bull ring 52. The material of desired micronized fineness is discharged by outlet 110 and conveyed by a suitable blower (not shown) to a place of use.

The improvement of the present invention, as seen in the figures, is the inclusion of a plurality of peripheral vertical static separators 200 about the perimeter of the grinding chamber 22, above at the level of the head member 36 and arms 42. Each peripheral vertical static separator 200 is constructed with a sloped upper surface 202 and a sloped lower surface 204, a first vertical end wall 205, and a second vertical end wall 206, providing a trapezoidal profile. A central portion 207 of each peripheral vertical static separator is constructed parallel to the grinding chamber perimeter to which it is secured. The specific size and placement of the peripheral vertical static separators is selected so as to increase the cross-sectional area of the grinding chamber at the level of the head member 36 and arms 42, thereby reducing the velocity of the gas or air flowing upward past the rollers 50 to a velocity substantially equivalent to that fluidizing the particulate material below the rollers 50, thereby overcoming the increased gas velocity problems associated with the user of larger head members 36 or additional rollers 50. In addition to equalizing the flow velocity of the air or gas passing upwards towards the separator chamber 100, oversize particulate material rejected by the separator blades 104, falling back towards the grinding chamber 22 may be deflected off the end walls 205, 206, and the lower surface 204 of the peripheral vertical static separator 200, and directed towards the grinding rollers 50, effectively increasing the number of material introduction points about the periphery of the grinding chamber 22. Finally, the centrifugal action of the head member 36 and arms 42 ejects or flings oversize particulate material into the peripheral vertical static separators 200, wherein it falls back to the grinding roller 200, thereby acting as a first stage separator and reducing the amount of oversize material reaching the separator chamber 100 which must be rejected therein. By reducing the quantity of oversize material in the separator chamber 100, the separator motor 108 may be run at a lower speed, reducing energy consumption and wear on the components and the roller mill runs smoother with less vibration.

In a first alternative embodiment, each peripheral vertical static separator 200 may be constructed in a smoothly curved profile, instead of the trapezoidal profile, to provide for an optimum airflow around the head member 36 and arms 42.

In a second alternative embodiment, the plurality of peripheral vertical static separators 200 may be replaced by a single continuous peripheral vertical static separator 200 extending about the entire circumference of the grinding chamber 22 at the level of the head member 36.

Figure 4:
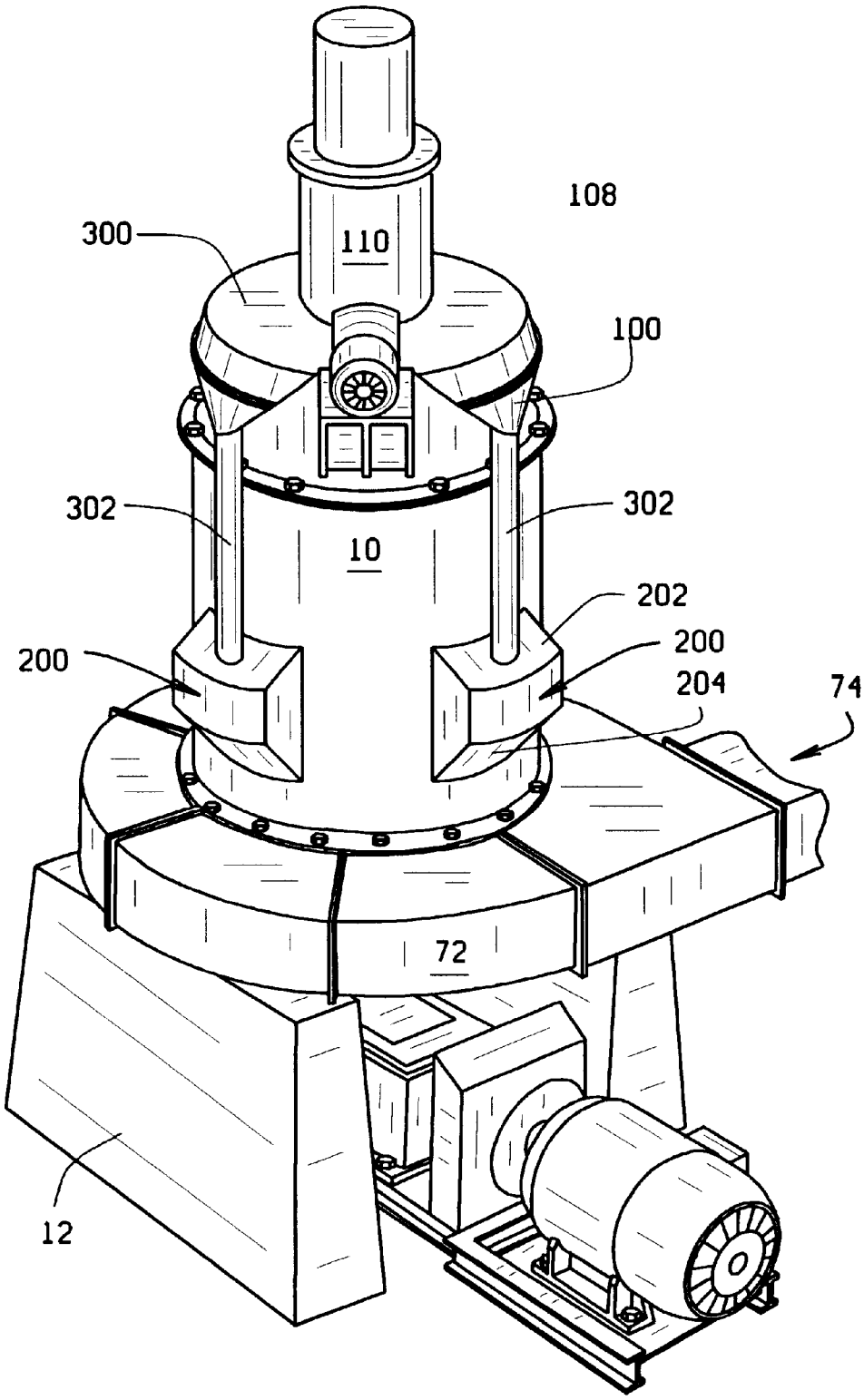
FIG. 4 is a perspective view of a an alternate embodiment grinding mill and separator employing peripheral vertical static separators of the present invention in combination with oversize particle return lines from the separator.
Figure 5:
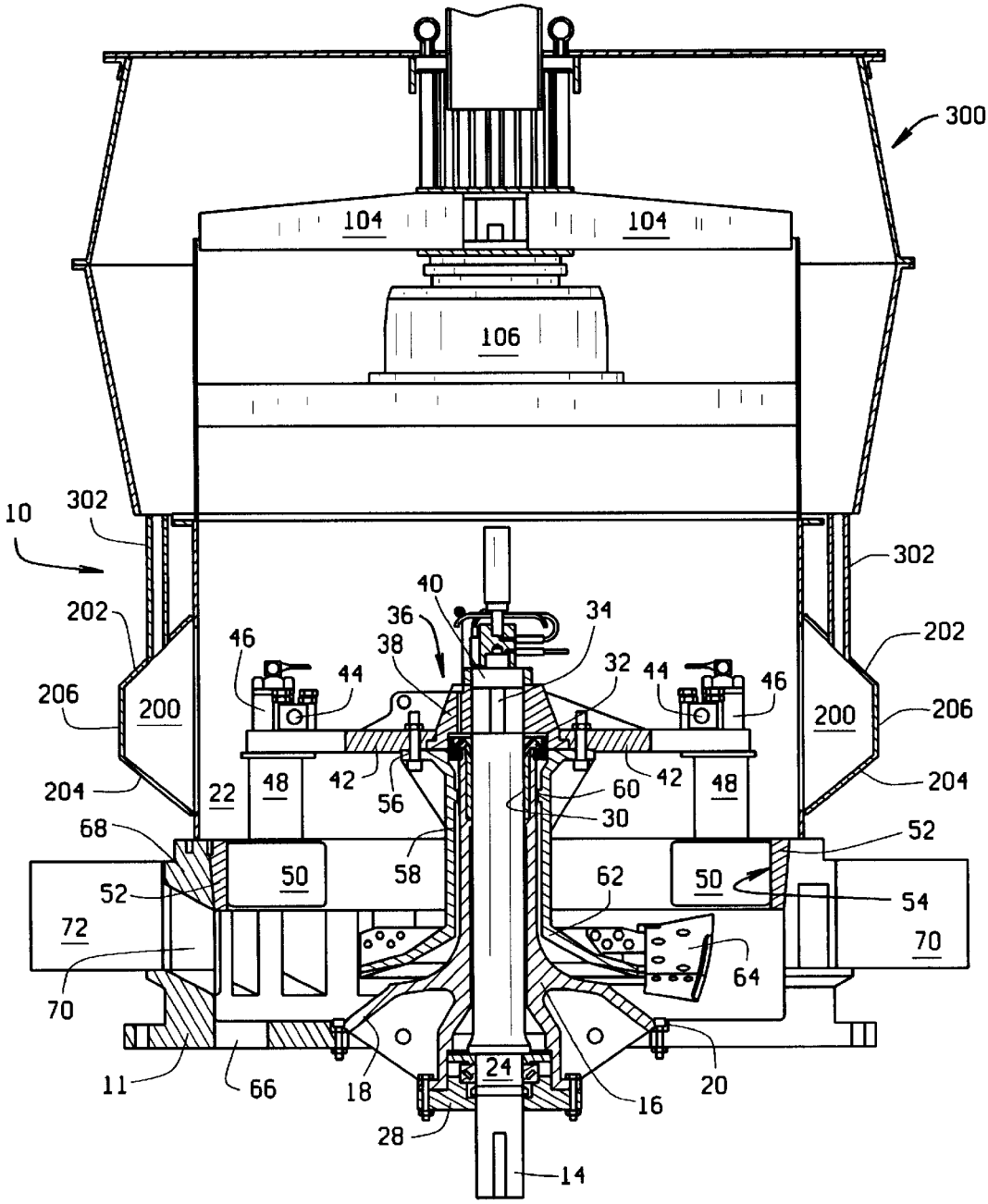
FIG. 5 is a longitudinal cross-sectional representation of the grinding mill and separator of FIG. 4.

In a third alternate embodiment, illustrated in FIGS. 4 and 5, the separator chamber 100 may be provided with an outer casing 300 as disclosed in U.S. Pat. No. 5,279,466 to Williams for directing oversize particulate material rejected by the separator back to the grinding chamber 22 down one or more return pathways 302. In the third alternate embodiment, the return pathways from the separator chamber 100 are routed into the upper surfaces 202 of the peripheral vertical static separators 200, thereby directing the rejected particulate material back into the grinding chamber 22 down a pathway which will minimize interference with particulate material being transported upward from the grinding chamber into the separator chamber, and enhancing the efficiency of the grinding apparatus.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. In an apparatus for grinding material to predetermined fineness in a grinding chamber having a circumferential wall supporting a grinding surface, grinding rollers mounted in the grinding chamber to grind material against said grinding surface, material feed mechanisms configured to introduce particulate material into the grinding chamber, an air bustle surrounding the grinding chamber and receiving a supply of air or other fluidizing gas, and a plurality of openings to and spaced around the circumferential wall of the grinding chamber through which the air or other fluidizing gas in the air bustles passes to convey the particulate material upward past the grinding rollers and grinding surface, the improvement characterized by:

at least one peripheral vertical static separator formed in the circumferential wall of said grinding chamber, said peripheral vertical static separator sized to enlarge the cross-sectional area of said grinding chamber through which said air or fluidizing gas conveys said ground particulate material, wherein an upward velocity of said air or fluidizing gas past said grinding rollers is substantially equivalent to a velocity of said air or fluidizing gas upon entering said grinding chamber.

2. The improvement set forth in claim 1 wherein said at least one peripheral vertical static separator is continuous about the circumference of said circumferential wall of said grinding chamber.

3. The improvement set forth in claim 1 wherein said at least one peripheral vertical static separator includes upper and lower surfaces, said upper and lower surfaces configured to redirect impinging particulate material into said grinding chamber.

4. The improvement set forth in claim 1 wherein said at least one peripheral vertical static separator includes first and second end walls, said first and second end walls configured to redirect impinging particulate material into said grinding chamber.

5. In an apparatus for grinding material to predetermined fineness in a grinding chamber having a circumferential wall supporting a grinding surface, grinding rollers mounted in the grinding chamber to grind material against said grinding surface, material feed mechanisms configured to introduce particulate material into the grinding chamber, an air bustle surrounding the grinding chamber and receiving a supply of air or other fluidizing gas, and a plurality of openings to and spaced around the circumferential wall of the grinding chamber through which the air or other fluidizing gas in the air bustles passes to convey the particulate material upward past the grinding rollers and grinding surface to a separator chamber wherein oversize particulate material is separated, the improvement characterized by:

at least one return pathway for said separated oversize particulate material which is isolated from said upward conveyed particulate material in the separator chamber, said return pathway terminating in at least one peripheral vertical static separator formed in the circumferential wall of said grinding chamber adjacent the grinding rollers, said peripheral vertical static separator sized to enlarge the cross-sectional area of said grinding chamber through which said air or fluidizing gas conveys said ground particulate material, wherein an upward velocity of said air or fluidizing gas past said grinding rollers is substantially equivalent to a velocity of said air or fluidizing gas upon entering said grinding chamber.

6. The improvement set forth in claim 5 wherein said at least one peripheral vertical static separator is continuous about the circumference of said circumferential wall of said grinding chamber.

7. The improvement set forth in claim 5 wherein said at least one peripheral vertical static separator includes upper and lower surfaces, said upper and lower surfaces configured to redirect impinging particulate material into said grinding chamber.

8. The improvement set forth in claim 5 wherein said at least one peripheral vertical static separator includes first and second end walls, said first and second end walls configured to redirect impinging particulate material into said grinding chamber.

9. In a material separator apparatus for classifying ground material discharged from a grinding chamber into fine and oversize particles, having a material grinding mechanism receiving material to be ground and an outlet for ground material, a separator operably connected to the outlet of said grinding mechanism for receiving the ground material to be classified, and an enclosure in the separator having an outlet formed with an internal space in which the ground material is classified and an external space communicating with said internal space, the improvement comprising:

at least one peripheral vertical static separator formed in a circumferential wall of said grinding chamber, said peripheral vertical static separator in communication with said external space and sized to enlarge the cross-sectional area of said grinding chamber through which said air or fluidizing gas conveys said ground particulate material, wherein an upward velocity of said air or fluidizing gas conveying said ground material into said separator is substantially equivalent to a velocity of said air or fluidizing gas upon entering said grinding chamber.

10. An apparatus for grinding particulate material to predetermined fineness comprising:

a grinding chamber having a circumferential wall supporting a grinding surface, said circumferential wall having at least one opening formed therein through which fluidizing gas can pass to convey the particulate material upward past the grinding rollers and grinding surface;

apparatus for introducing fluidizing gas into said grinding chamber;

grinding rollers mounted in the grinding chamber to grind particulate material against said grinding surface;

at least one material feed mechanism configured to introduce particulate material into the grinding chamber; and a first stage separator comprising at least one peripheral vertical separator on the grinding chamber wherein oversize particulate material is separated and directed back to the grinding rollers.

11. The apparatus of claim 10 further comprising a second stage separator at an outlet of the grinding chamber wherein oversize particulate material is separated and directed back to the grinding rollers.

12. In an apparatus for grinding material to predetermined fineness in a grinding chamber having a circumferential wall supporting a grinding surface, grinding rollers mounted in the grinding chamber to grind material against said grinding surface, material feed mechanisms configured to introduce particulate material into the grinding chamber, an air bustle surrounding the grinding chamber and receiving a supply of air or other fluidizing gas, and a plurality of openings to and spaced around the circumferential wall of the grinding chamber through which the air or other fluidizing gas in the air bustles passes to convey the particulate material upward past the grinding rollers and grinding surface, the improvement characterized by:

means for enlarging the cross-sectional area of said grinding chamber through which said air or fluidizing gas conveys said ground particulate material, whereby an upward velocity of said air or fluidizing gas past said grinding rollers is substantially equivalent to a velocity of said air or fluidizing gas upon entering said grinding chamber.

* * * * *